United States Patent [19]

Kishida et al.

[11] Patent Number: 4,729,872

[45] Date of Patent: Mar. 8, 1988

[54] ISOTROPIC TOOL STEEL

[75] Inventors: Tamiya Kishida; Mitsuru Suzuki, both of Yonago; Toshio Okuno, Yasugi; Atsusuke Nakao, Yanago, all of Japan

[73] Assignee: Hitachi Metals, Ltd., Japan

[21] Appl. No.: 906,031

[22] Filed: Sep. 10, 1986

[30] Foreign Application Priority Data

Sep. 18, 1985 [JP] Japan ..... 60-205858

[51] Int. Cl.[4] ..... C22C 38/22

[52] U.S. Cl. ..... 420/105; 420/106; 420/107; 420/108; 420/109; 420/110; 420/112; 420/114

[58] Field of Search ..... 420/105, 107, 109, 114, 420/122, 123, 124, 108, 112, 106, 110

[56] References Cited

U.S. PATENT DOCUMENTS

| | | | |
|---|---|---|---|
| 3,602,689 | 8/1971 | Heuschkel | 420/109 |
| 3,656,943 | 4/1972 | Heusehkel | 420/109 |
| 4,468,249 | 8/1984 | Lehman | 420/109 |

*Primary Examiner*—L. Dewayne Rutledge
*Assistant Examiner*—George Wyszomierski
*Attorney, Agent, or Firm*—Antonelli, Terry & Wands

[57] ABSTRACT

Isotropic tool steel consisting essentially of necessary elements as tool steel, less than 0.005 weight % of S and less than 30 ppm of O, the balance being substantially Fe. The necessary elements are, by weight, 0.10–0.70% of C, 2.00% or less of Si, 2.00% or less of Mn, 7.00% or less of Cr, 0.20–12.00% of W and/or Mo alone or in combination ($\frac{1}{2}$W+Mo), 3.00% or less of V. They may further include at least one of 4.00% or less of Ni, 6.50% or less of Co and 0.20% or less of N. The isotropic tool steel has cleanliness with respect to non-metallic inclusions defined by JIS G 0555 of $dA60\times400\leqq0.010\%$ and $d(B+C)60\times400\leqq0.020\%$, and a ratio of transverse direction toughness to longitudinal direction toughness of more than 0.70. Since it is highly resistant to the generation and propagation of cracks and fracture, dies for hot working made therefrom can enjoy a long life.

9 Claims, 4 Drawing Figures

ISOTROPIC TOOL STEEL

BACKGROUND OF THE INVENTION

The present invention relates to tool steel for hot working and cold working, and more particularly to highly isotropic tool steel having high toughness and ductility, which can enjoy a long life without cracking under severe thermal and mechanical stress when used for various hot working dies such as hot forging dies, aluminum die-casting dies and aluminum extrusion dies, and whose hardness can be increased because of a high resistance to cracking so that its life in terms of wear resistance can be elongated.

Dies for cold working and hot working have recently been getting bigger, more complicated in shape, more efficient in forging due to more rapid cooling from die surfaces and more sharpened at die edges and corners for enhancing forging precision, resulting in early or premature fracture or breaking of the dies. And because higher forging precision is required, the slightest dulling and wear of die edges and surfaces has increasingly led to forged products failing to meet the required size and shape precision. Thus, the dies cannot be used for a long period of time. To prevent early or premature deformation and wear, attempts have been made to enhance the hardness of dies, but enhancing the hardness merely led to early breaking of the dies.

Tool steel is usually forged so that it is elongated in the forging direction. This direction of elongation by forging is usually called "longitudinal direction," and a direction perpendicular thereto is called "transverse direction."

In conventional tool steel for hot working, toughness is lower in the transverse direction than in the longitudinal direction. The transverse direction and the longitudinal direction are simply called T-direction and L-direction, respectively. For conventional tool steel, a ratio of T-direction toughness to L-direction toughness is usually 0.6 or so. Incidentally, the T-direction toughness means toughness measured with respect to cracks generated and propagating along fiber flows in a die during hot working, and the L-direction toughness means toughness measured with respect to cracks propagating perpendicularly to the fiber flows.

Therefore, the conventional tool steel is vulnerable to cracking and fracture along the fiber flows, so that dies made from such tool steel have a life to cracking mostly determined by the toughness and ductility thereof in the transverse direction which are lower than those in the longitudinal direction. The reason therefor is that long clusters of non-metallic inclusions extending along the direction of elongation by forging tend to be spots from which peeling and breaking initiate, so that cracks are likely to be generated and propagate along the clusters, namely fibers. Further, when there is extreme compositional segregation in the banded segregation having a large band width and extending along the direction of elongation by forging, and when it is highly aligned to the direction of fibers, cracks are likely to propagate linearly along the banded segregation.

OBJECT AND SUMMARY OF THE INVENTION

An object of the present invention is, therefore, to provide isotropic tool steel having toughness in the transverse direction enhanced as close as to that in the longitudinal direction, so that it can enjoy a long life when used for dies for hot working and cold working.

In view of the above object, the inventors have done intense research. As a result, it has been found that the toughness of tool steel in the transverse direction can be improved extremely closer to that in the longitudinal direction by reducing the amount of sulfide inclusions particularly prone to extend along the fiber flows, namely in the direction of forging elongation to the lowest possible level, and further reducing silicate inclusions and oxide inclusions as much as possible, thereby providing the tool steel with extremely high cleanliness with respect to such non-metallic inclusions. It has also been found that a combination of proper diffusion soaking for reducing micro-segregation and hot working at a forging ratio properly set for controlling the shapes of non-metallic inclusions further reduces the chances of fracture or breaking in the above-mentioned manner, making the toughness of the tool steel in the transverse direction further closer to or even nearly equal to the level in the longitudinal direction.

That is, isotropic tool steel according to the present invention consists essentially of necessary elements as tool steel, less than 0.005 weight % of S and less than 30 ppm of O, the balance being substantially Fe.

DETAILED DESCRIPTION OF THE INVENTION

Figure 1:
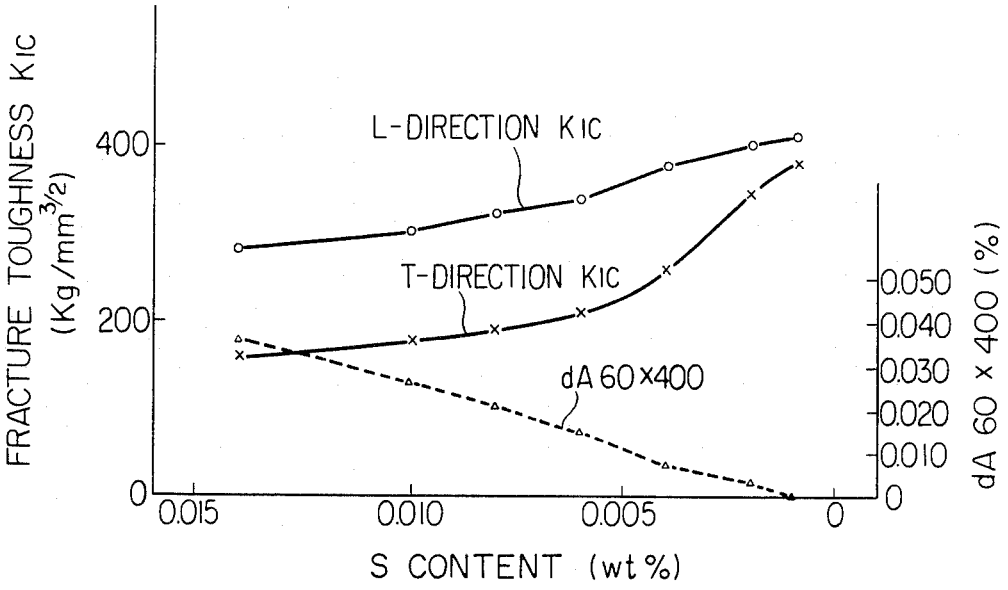
FIG. 1 is a graph showing the relations of an S content with an areal ratio of sulfide inclusions and plane strain fracture toughness $K_{IC}$ in the longitudinal direction as well as in the transverse direction.

Japanese Industrial Standard (JIS) G 0555 classifies non-metallic compounds as follows:

(1) A-type inclusions—Inclusions formed by viscous deformation during working such as sulfides, silicates, etc.

(2) B-type inclusions—Granular inclusions discontinuously and collectively arranged in the forging direction (alumina, etc.).

(3) C-type inclusions—Inclusions irregularly dispersed without viscous deformation (granular oxide, etc.).

The cleanliness of steel with respect to such nonmetallic inclusions is determined as follows:

A steel specimen is observed repeatedly at random by a microscope through a glass plate having 20 grating lines both longitudinally and laterally, and the number of grating points occupied by the inclusions are counted. The number of visual fields are 60 as a rule and should be at least 30 in any case. The magnification of the microscope is 400. The total number (p) of grating points of the glass plate in a visual field, the number (f) of the visual fields observed and the cumulative number (n) of grating points occupied by the inclusions observed through the f visual fields are counted. Thus, it is determined by the following formula:

$$d = \frac{n}{p \times f} \times 100$$

The cleanliness "d" is expressed like dA60×400=0.34% in which A denotes A-type inclusions, 60 denotes the number (f) of visual fields observed and 400 denotes the magnification of a microscope used.

Accordingly the cleanliness dA60×400≦0.010% and d(B+C)60×400≦0.020% means that the cleanliness of the tool steel with respect to A-type inclusions (sulfides and silicates) and that with respect to B-type inclusions (alumina, etc. and oxides) both measured by 60 visual fields and the magnification of 400 are 0.010% or less and 0.020% or less, respectively.

The isotropy of the tool steel according to the present invention is expressed by a ratio of toughness in the transverse direction to toughness in the longitudinal direction. The term "longitudinal direction" used herein means a direction in which the tool steel is elongated by forging, which may be referred to simply as "L-direction." And the term "transverse direction" used herein means a direction perpendicular to the longitudinal direction, which may be referred to simply as "T-direction." Further, the toughness in L-direction and the toughness in T-direction are referred to simply as "L-direction toughness" and "T-direction toughness," respectively.

The tool steel according to the present invention contains less than 0.005 weight %, preferably less than 0.003 weight % of S and less than 30 ppm, preferably less than 20 ppm of O, so that it has the cleanliness of dA60×400≦0.010%, preferably dA60×400≦0.005% and d(B+C)60×400≦0.020%, 20 preferably d(B+C)60×400≦0.010%. When the cleanliness of tool steel with respect to non-metallic inclusions determined by JIS G 0555 is dA60×400≦0.010% and d(B+C)60×400≦0.020%, the ratio of T-direction toughness to L-direction toughness is more than 0.70. Preferably, the cleanliness is dA60×400≦0.005% and d(B+C)60×400≦0.010%, and the ratio of T-direction toughness to L-direction toughness is 0.85 or more.

Included as necessary elements in the tool steel which contains the above-mentioned amount of S and 0, and has the desired cleanliness with respect to non-metallic inclusions and the desired isotropy expressed by a ratio of T-direction toughness/L-direction toughness are, by weight, 0.10–0.70% of C, 2.00% or less of Si, 2.00% or less of Mn, 7.00% or less of Cr, 0.20–12.00% of W and/or Mo alone or in combination ($\frac{1}{2}$W+Mo) and 3.00% or less of V. The tool steel containing these necessary elements may further contain at least one of 4.00% or less of Ni, 6.50% or less of Co and 0.20% or less of N. It may also contain 0.50% or less of special carbide-forming elements such as Nb and Ti alone or in combination, and 3.00% or less of precipitation hardening elements capable of forming intermetallic compounds such as Cu, B, Al and Be alone or in combination.

More specifically, a preferred isotropic tool steel for hot working consists essentially, by weight, of 0.30–0.45% of C, 0.30–1.50% of Si, 0.80% or less of Mn, 4.50–5.50% of Cr, 1.00–1.60% of Mo, 0.50–1.30% of V, less than 0.005% of S, less than 30 ppm of O and the balance being substantially Fe, and has cleanliness with respect to non-metallic inclusions determined by JIS G 0555 of dA60×400≦0.010% and d(B+C)60×400≦0.020%, and a ratio of T-direction toughness to L-direction toughness of more than 0.70.

Another preferred isotropic tool steel for hot working consists essentially, by weight, of 0.50–0.60% of C, 0.50% or less of Si, 0.60–1.00% of Mn, 1.30–2.00% of Ni, 0.70–1.50% of Cr, 0.20–0.50% of Mo, 0.10–0.20% of V, less than 0.005% of S, less than 30 ppm of O and the balance being substantially Fe, and has cleanliness with respect to nonmetallic inclusions determined by JIS G 0555 of dA60×400≦0.010% and d(B+C)60×400≦0.020%, and a ratio of T-direction toughness to L-direction toughness of more than 0.70.

The necessary elements in the present invention will be explained in detail.

C is an indispensable element in that it is dissolved in the steel matrix by heating for hardening so that it provides necessary hardness to the tool steel, that it is combined with special carbide-forming elements by tempering to precipitate special carbides thereby providing the tool steel with high resistance to softening by tempering and high-temperature strength, that it forms residual carbides which remain even at high temperatures thereby enhancing wear resistance at high temperatures, and that it prevents crystal grains from growing to excessively large particles by heating for hardening. When C is more than 0.70 weight excess carbides are formed thereby lowering toughness and high-temperature strength necessary for hot working tools. On the other hand, when C is less than 0.10 weight %, the above-mentioned effects of carbon cannot be achieved. Accordingly, C is within the range of 0.10–0.70 weight %.

Si is generally necessary as a deoxidizer, and it also enhances oxidation resistance and resistance to softening by tempering at 500–600° C. or less, and further elevates an $A_1$ transformation temperature of the tool steel. When it exceeds 2.00 weight %, however, it reduces not only toughness but also thermal conductivity of the tool steel excessively. Accordingly, Si is 2.00 weight % or less, though its amount may vary within the above range depending on purposes and applications.

Mn is highly effective for enhancing hardenability effects by being dissolved in the steel matrix to form a solid solution. To obtain such effects, the amount of Mn is controlled depending on applications of the tool steel. When it exceeds 2.00 weight %, it increases annealing hardness excessively thereby lowering machinability and further excessively lowers the $A_1$ transformation temperature. Accordingly, M is 2.00 weight % or less.

Cr is the most important element for providing hardenability necessary for tool steel. Also, it serves to increase oxidation resistance, and elevate the $A_1$ transformation temperature and form the residual carbides, thereby preventing crystal grains from growing excessively by heating for hardening, and increasing wear resistance. In addition, it is effective for precipitating special carbides by tempering, thereby improving resistance to softening at elevated temperatures and enhancing high-temperature strength. When Cr is more than 7.00 weight %, excess Cr carbides are formed, leading to lower high-temperature strength. Accordingly, Cr is 7.00 weight % or less. Incidentally, Cr may not be contained, but for the purpose of obtaining the above-mentioned effects, it is preferably added in an amount of 0.70 weight or more.

W and Mo form special carbides. They are the most important elements for forming the residual carbides which remain even at high temperatures, thereby preventing grains from growing excessively by heating for hardening, and for precipitating fine special carbides by tempering, thereby enhancing resistance to softening by tempering and high-temperature strength They also serve to elevate the $A_1$ transformation temperature of the tool steel. W is particularly effective for increasing the high-temperature strength and the wear resistance of the tool steel, and Mo is more advantageous than W in increasing the toughness. However, when they are contained excessively, too large carbides are formed in the tool steel, leading to an excessively low level of toughness. On the other hand, when they are less than 0.20 weight %, the above effects cannot sufficiently be achieved. Accordingly, W and Mo are 0.20–12.00 weight % when added alone, and when added in combination, ($\frac{1}{2}$W+Mo) is 0.20–12.00 weight %.

V is a strong carbide-forming element. It effectively forms the residual carbides thereby providing fine crystal grains and enhancing wear resistance at high temperatures. Also, by tempering, it effectively precipitates fine carbides in the steel matrix, thereby in cooperation with W and Mo enhancing strength at high temperatures of 600–650° C. or more. It further elevates the $A_1$ transformation temperature of the steel. Despite the above effects, excess V leads to the formation of too large carbides, resulting in the decrease in toughness. Therefore, V is 3.00 weight % or less. Though V may not be added, it is preferably added in an amount of 0.05 weight % or more for achieving the above-mentioned effects.

Ni is dissolved in the steel matrix thereby enhancing its toughness and hardenability. Thus, it may be added depending on purposes and applications. However, when Ni exceeds 4.00 weight %, it works to excessively increase annealing hardness of the tool steel, thereby lowering its machinability, and also it excessively lowers the $A_1$ transformation temperature. Accordingly, Ni should be 4.00 weight % or less.

Co serves to enhance the high-temperature strength of the tool steel by being dissolved in its matrix. It also increases the upper limit of the amount of carbides soluble in the austenite by heating for hardening, thereby increasing the amount of special carbides precipitated by annealing. It further decreases the tendency of precipitated carbides to gather together at elevated temperatures, which contributes to the improvement of high-temperature mechanical properties of the tool steel. In addition, Co contributes to the formation of a dense oxidation layer strongly adhered onto a tool steel surface by temperature increase while using the tool steel, thereby increasing the wear resistance and burning resistance of the tool steel at high temperatures. Accordingly, Co may be added depending on purposes and applications, but when it exceeds 6.50 weight %, it rather deteriorates the toughness of the tool steel. Therefore, Co should be 6.50 weight % or less, if added.

N makes it possible for the tool steel to have excellent toughness, because N is dissolved in the matrix and carbides of the tool steel thereby making its crystal grains finer, and because it serves as an austehite former which prevents ferrite from remaining even with a small carbon content by heating for hardening. N may be added for the above effects depending on purposes and applications, but it has an upper limit of 0.20 weight % within the alloy composition (including Cr, etc.) of tool steel for hot working.

Nb and Ti are strong carbide-forming elements, and are effective for making the crystal grains finer and for precipitating fine carbides having an especially low tendency of gathering together by tempering, thereby increasing resistance to softening at high temperatures of 650° C. or more and high-temperature strength. They may be added for the above effects depending on purposes and applications. However, the addition of excess Nb and/or Ti leads to the decrease in toughness due to the formation of large carbides less soluble in the matrix. Therefore, Nb and Ti should be 0.5 weight % or less alone or in combination.

Cu, B, Al and Be serve to precipitate intermetallic compounds, effective for improving the resistance to softening by temperature increase and the high-temperature strength. When they are added excessively, they adversely affect the toughness of the tool steel. Accordingly, they should be 3.00 weight % or less alone or in combination.

The tool steel of the present invention can be melted and formed into ingots by inexpensive mass-production methods such as electric furnace refining and ladle refining without resorting to special methods such as vacuum melting and consumable electrode melting which are expensive and less efficient.

In the production of the tool steel of the present. invention, the ladle refining is advantageously carried out for the purpose of efficient desulfurization and doxidation after the amount of [O] contained in the molten steel is reduced to 100 ppm or less by oxidation refining and reduction refining in an electric furnace.

In order to enhance the efficiency of the desulfurization by a slag-molten steel reaction, the desulfurization is advantageously performed quickly to an extremely low sulfur level of less than 0.005 weight % by the ladle refining using an electromagnetic stirring, while simultaneously blowing an Ar gas into the molten steel from below so that the [0]content in the molten steel is further reduced to less than 30 ppm. As a result of such desulfurization, the tool steel of the present invention contains less than 0.005 weight of S and less than 30 ppm of 0, preferably less than 0.003 weight % of S and less than 20 ppm of O which S and O contents are extremely lower than those of conventional steel. The cleanliness of the tool steel of the present inveniton with respect to non metallic inclusions defined by JIS G 0555 is $dA60\times400\leqq0.010\%$ and $d(B+C)60\times400\leqq0.020\%$, preferably $dA60\times400\leqq0.005\%$ and $d(B+C)60\times400\leqq0.010\%$. The amount and the size of the sulfur inclusions and the oxide inclusions are much smaller in the tool steel of the present invention than in the conventional steel.

The present invention will be explained in further detail by the following Examples.

EXAMPLE 1

Table 1 shows various compositions of tool steel corresponding to JIS SKD 61, of which Samples A–C are those of the present invention, Samples D–F are Comparative Examples and Sample G is a conventional steel. Their cleanliness with respect to non-metallic inclusions are also shown in Table 1.

TABLE 1

| Sample* | Composition (wt %) | | | | | | | | | Cleanliness (%) | |
|---|---|---|---|---|---|---|---|---|---|---|---|
| | C | Si | Mn | Cr | Mo | V | S | O** | Fe | dA 60 × 400 | d (B + C) 60 × 400 |
| A | 0.39 | 0.87 | 0.41 | 5.21 | 1.38 | 0.70 | 0.001 | 10 | Bal. | 0 | 0.008 |
| B | 0.40 | 0.86 | 0.41 | 5.25 | 1.39 | 0.68 | 0.002 | 11 | " | 0.004 | 0.012 |
| C | 0.39 | 0.85 | 0.40 | 5.24 | 1.37 | 0.70 | 0.004 | 15 | " | 0.008 | 0.016 |
| D | 0.40 | 0.89 | 0.43 | 5.25 | 1.36 | 0.69 | 0.006 | 32 | " | 0.016 | 0.024 |
| E | 0.38 | 0.89 | 0.44 | 5.30 | 1.35 | 0.68 | 0.008 | 35 | " | 0.020 | 0.028 |
| F | 0.39 | 0.90 | 0.43 | 5.31 | 1.38 | 0.71 | 0.010 | 40 | " | 0.028 | 0.032 |
| G | 0.41 | 0.88 | 0.40 | 5.25 | 1.36 | 0.72 | 0.014 | 37 | " | 0.036 | 0.032 |

Note:
*Samples A–C are according to the present invention, Samples D–F Comparative Examples and Sample G a conventional steel.
**ppm With respect to Samples A–G, plane strain fracture toughness $K_{IC}$ in the direction of elongation by forging (longitudinal direction or L-direction) hereunder referred to as "L-direction fracture toughness" or simply "L-direction $K_{IC}$," and plane strain fracture toughness $K_{IC}$ in the transverse direction (T-direction) perpendicular to the longitudinal direction hereunder referred to as "T-direction fracture toughness" or simply "T-direction $K_{IC}$" were measured. They are shown in relation to the sulfur content in FIG. 1 together with an areal ratio of sulfide inclusions (dA60×400). Incidentally, these samples were forged at a solid forging ratio of 6.5 and a total forging ratio of 15.

The above solid forging ratio is expressed by a ratio of a cross-section area of a steel sample after a forging to a cross-section area of the same steel sample before forging. The above total forging ratio is used when a plurality of forging operations are performed from various angles. Asuming that individual forging operations have forging ratios of A, B, C, . . . , the total forging ratio is expressed by AxBxC . . . no matter how the steel sample has changed its cross section by forging.

As the sulfur content decreases from 0.014 weight to 0.006 weight % (samples G to D), both amount and size of the sulfide inclusions decrease gradually while both L-direction $K_{IC}$ and T-direction $K_{IC}$ increase gradually. It is clearly observed that once the sulfur content is reduced to less than 0.005 weight %, particularly to less than 0.003 weight %, the T-direction fracture toughness increases drastically whereby the difference between the L-direction $K_{IC}$ and the T-direction $K_{IC}$ decreases dramatically.

Although it has conventionally been pointed out that the decrease in the sulfur content leads to higher T-direction fracture toughness so that it gets closer to L-direction fracture toughness, such relation has never been investigated at such a low sulfur content level as less than 0.005 weight %. As a result of extensive research on the relation between the L- and T- fracture toughness and such extremely low sulfur content, the inventors have found a critical point of the sulfur cntent, which is 0.005 weight particularly 0.003 weight %; the reduction of the sulfur content below such a critical point leads to a rapid increase in the T-direction fracture toughness. The resulting mechanical properties are surmounting any expectations on conventional tool steel for hot working.

EXAMPLE 2

Samples B and G each having hardness HRC of 45 after heat treatment (hardening and tempering) were forged at a forging ratio of 0–20, and test pieces having longitudinal directions in parallel with the directions of elongation by forging (simply referred to as L-direction test pieces) and those whose test direction is perpendicular to the direction of elongation by forging (simply referred to as T-direction test pieces) were machined therefrom. Both L-direction and T-direction test pieces were measured at various forging ratios with respect to Charpy impact strength. Incidentally, because these samples were subjected to up setting before the above forging, their total forging ratios were 0–50. The relations between Charpy impact strength and the forging ratio are shown in FIG. 2.

Figure 2:
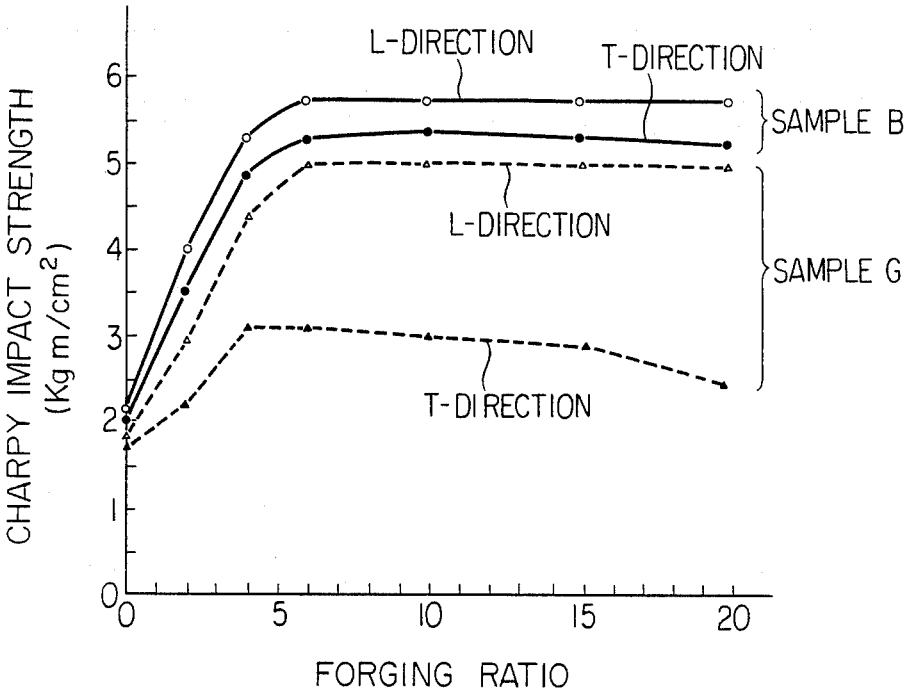
FIG. 2 is a graph showing the relations between a forging ratio and Charpy impact strength with respect to the tool steel of the present invention and the conventional steel.

FIG. 2 shows that the T-direction test piece of Sample G containing 0.014 weight % of S has toughness which increases dramatically as the forging ratio increases up to about 4–6, at which the toughness reaches a plateau, but that the maximum toughness of the T-direction test piece is only about 60% of that of the L-direction test piece, which means that a ratio of T-direction toughness to L-direction toughness is about 0.6 for Sample G. Further, as the forging ratio exceeds about 10, the toughness of the T-direction test piece decreases gradually.

On the other hand, the T-direction test piece of Sample B containing 0.002 weight % of S according to the present invention has toughness which increases much more dramatically than the counterpart of Sample G at a forging ratio of up to about 5, and is on the maximum level at a forging ratio of about 4–about 10. The T-direction toughness of Sample B is extremely higher than that of Sample G, and also higher than even the L-direction toughness of Sample G. Further, Sample B's T-direction toughness is 85% or more as much as its L-direction toughness. In addition, the toughness of the T-direction test piece of Sample B decreases much more slowly than that of the conventional steel (Sample G), and the T-direction test piece of Sample B suffers from only a slight decrease in Charpy impact strength even at as high a forging ratio as about 20. Thus, the forging ratio which can provide Sample B with sufficient toughness is 1–20 (total forging ratio: 1.5 or more), and preferably 4–10 (total forging ratio: 4 or more).

EXAMPLE 3

This Example is to show the effects of soaking on Charpy impact strength. Ingot soaking and billet soaking were conducted on each of Sample B containing 0.002 weight % of S and having hardness HRC of 45 after heat treatment (hardening and tempering). The conditions of the ingot soaking were 1200° C. or higher for 10 hours at a forging ratio of 5.0 (total forging ratio of 12.0), and those of the billet soaking were 1200° C or higher for 10 hours at a forging ratio of 1 (total forging ratio of 2.3). Incidentally, the billet soaking was conducted on a sample which had experienced no ingot soaking. Each of soaked samples and an unsoaked sample was forged to the same total forging ratio of 2.3, and L-direction and T-direction test pieces were machined therefrom.

Figure 3:
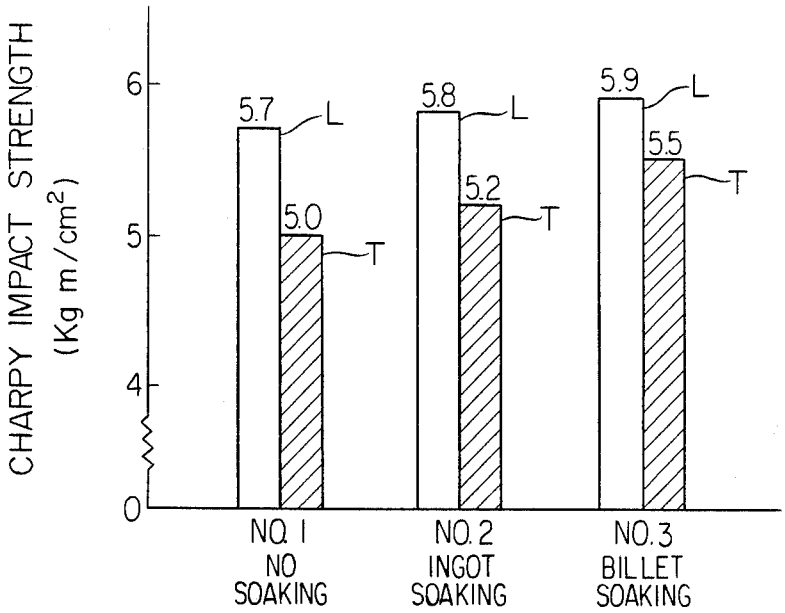
FIG. 3 is a graph showing the effects of soaking on Charpy impact strength with respect to the tool steel of the present invention.

FIG. 3 shows the relations between Charpy impact strength in the longitudinal direction (L-direction) and that in the transverse direction (T-diretion) for the test pieces; No. 1 with no soaking, No. 2 ingot soaking and No. 3 billet soaking. It is evident from FIG. 3 that a ratio of T-direction Charpy impact strength to L-direction Charpy impact strength is 0.88 for the sample No. 1 with no soaking, 0.90 for the sample No. 2 with ingot soaking and 0.92 for the sample No. 3 with billet soaking. Accordingly, it may be appreciated that the soaking which reduces microsegregation in solidification helps increase the Charpy impact strength of the tool steel of the present invention.

EXAMPLE 4

The T-direction test pieces of Samples B and G (HRC=44) containing 0.002 weight % of S and 0.014 weight of S, respectively were measured with respect to V notch Charpy impact strength at various temperatures between 20° C. and 300° C. Incidentally, each test piece had undergone forging at a forging ratio of 5.0 (total forging ratio of 12.5). The results are shown in FIG. 4.

Figure 4:
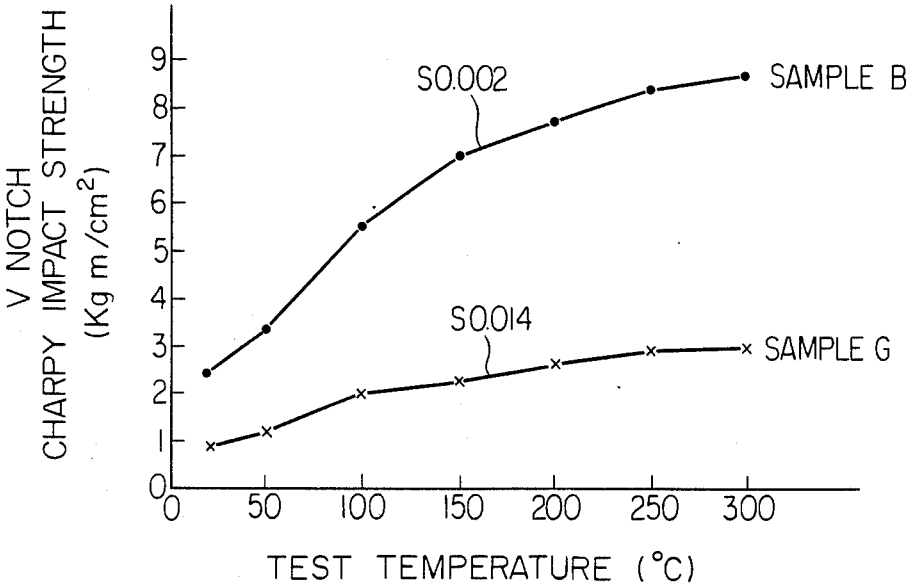
FIG. 4 is a graph showing the temperature transition characteristics of impact strength with respect to the tool steel of the present invention and the conventional tool steel.

FIG. 4 shows the variations with temperature of energy absorbed by fracture with test temperature. For the test piece of Sample G containing 0.014 weight % of S, 50-% brittle fracture transition temperature is 50°-100° C., and the increase in absorption energy with test temperature increase is appreciated. However, when the temperature exceeds 100° C., the above increase becomes slight.

On the other hand, for the test piece of Sample B according to the present invention, the 50-% brittle fracture transition temperature is similarly 50°-100° C., but it is apparent that the increase in absorption energy with test temperature increase is conspicuous. Therefore, when dies are prepared from the tool steel of the present invention, the dies can have large impact absorption energy by preheating, so that they are remarkably resistant to breaking as compared with those prepared from convenitonal tool steel.

EXAMPLE 5

The following four types of tool steel each containing sulfur in amounts as shown in Table 2 were desulfurized to the levels of the present invention also as shown. in Table 2.

SKT4: 0.52%C-0.21%Si-0.85%Mn-1.65%Ni-1.03%Cr-0.40%Mo-0.16%V-bal.Fe

SKD8: 0.40%C-0.22%Si-0.34%Mn-4.36%Cr-4.35%W-0.35%Mo-1.98%V-4.30%Co-bal.Fe

3Ni-3Mo: 0.19%C-0.25%Si-0.60%Mn-3.32%Ni-3.42%Mo-bal.Fe

10Cr-Mo-V-N: 0.31%C-0.33%Si-0.65%Mn-10.25%Cr-1.58Mo-0.97%V-bal.Fe

Test pieces made from the tool steel of the present invention and from the conventional tool steel were measured with respect to plane strain fracture toughness in the longitudinal direction as well as in the transverse direction, and a ratio of T-direction toughness to L-direction toughness was calculated. The results are shown in Table 2.

TABLE 2

| Sample | Hardness (HRC) | Sulfur Content (wt %) | Plane Strain Fracture Toughness (kg/mm$^{3/2}$) L | T | T-Direction Toughness/ L-Direction Toughness |
|---|---|---|---|---|---|
| SKT4 | 41 | 0.013 | 335 | 224 | 0.67 |
| | | 0.002 | 350 | 322 | 0.92 |
| SKD8 | 44 | 0.012 | 135 | 88 | 0.65 |
| | | 0.001 | 140 | 125 | 0.89 |
| 3Ni—3Mo | 38 | 0.013 | 262 | 173 | 0.66 |
| | | 0.002 | 270 | 245 | 0.90 |
| 10Cr—Mo—V—N | — | 0.011 | 320 | 218 | 0.68 |
| | | 0.001 | 330 | 304 | 0.92 |

Note:
for each Sample, the upper line indicates the data of the conventional steel and the lower line indicates the data of the steel according to the present invention (after desulfurization).

It is apparent from Table 2 that the conventional samples are extremely inferior in T-direction toughness as shown by a ratio of T-direction toughness to L-direction toughness of less than 0.70, while the samples of the present invention are remarkably improved in T-direction toughness, having excellent isotropy as shown by the ratio of T-direction toughness to L-direction toughness which is far beyond 0.70 and higher than even 0.85.

EXAMPLE 6

Various types of tool steel corresponding to SKD61, SKT4 and SKD7 were provided. Using these materials, two dies for hot press forging, a die for pecision hot press forging, a die for hot hammer forging and a die for aluminum die casting were manufactured. A die life was measured on each of the above dies. The results are shown in Table 3.

TABLE 3

| No. | Tool Steel | Die | Die Life (Shot) (1) | (2) |
|---|---|---|---|---|
| 1 | SKD61 | For Hot Press Forging | 6500(3) | 14000 |
| 2 | SKD61 | For Hot Press Forging | 7000(4) | 15000 |
| 3 | SKT4 | For Hot Hammer Forging | 8000(5) | 12000(5) |
| 4 | SKD61 | For Aluminum Die Casting | 50,000(6) | 90,000(6) |
| 5 | SKD7(7) | For Precision Hot Press Forging | 25,000(8) | 32,500(9) |

Note:
(1)Conventional tool steel.
(2)Present invention.
(3)Surface roughening was caused by cracks.
(4)Die was broken.
(5)Resinking was needed due to cracks.
(6)Repairing was needed due to heat cracks.
(7)With nitride coating.
(8)Discarded by wear (HRC = 45).
(9)Discarded by wear (HRC = 48).

As is apparent from Table 3, the dies respectively for hot press forging, for hot hammer forging and for aluminum die casting each made from the tool steel of the present invention are highly resistant to the generation and propagation of cracks, preventing fracture thereof. Accordingly, they enjoy two to three times as long a life as those of the conventional tool steel, which means that the tool steel of the present invention can provide forging dies having high stability and performance for practical use.

As mentioned above, the tool steel of the present invention has high toughness and ductility, and is highly isotropic because of small differences in properties between the longitudinal direction and the transverse direction. Accordingly, when applied for various dies for hot working, early fracture or breaking does not take place, and cracks are not generated early and hardly propagate in the dies. Therefore, the dies made from the tool steel of the present invention can enjoy a long life and high stability.

What is claimed is:

1. Isotropic tool steel for hot working consisting essentially, by weight, of 0.30–0.45% of C, 0.30–1.50% of Si, 0.80% or less of Mn, 4.50–5.50% of Cr, 1.00–1.60% of Mo, 0.50–1.30% of V, less than 0.005% of S and less than 30 ppm of O, the balance being substantially Fe, the cleanliness of said tool steel with respect to non-metallic inclusions determined by JIS G 0555 being $dA60\times400\leqq0.010\%$ and $d(B+C)60\times400\leqq0.020\%$, and a ratio of transverse direction toughness to longitudinal direction toughness, wherein said longitudinal direction means a direction of elongation by forging and said transverse direction means a direction perpendicular to said longitudinal direction, being more than 0.70.

2. The isotropic tool steel according to claim 1, wherein S is less than 0.003 weight %.

3. Isotropic tool steel for hot working consisting essentially, by weight, of 0.50–0.60% of C, 0.50% or less of Si, 0.60–1.00% of Mn, 1.30–2.00% of Ni, 0.70–1.50% of Cr, 0.20–0.50% of Mo, 0.10–0.20% of V, less than 0.005% of S, less than 30 ppm of O and the balance being substantially Fe, the cleanliness of said tool steel with respect to nonmetallic inclusions determined by JIS G 0555 being $dA60\times400\leqq0.010\%$ and $d(B+C)60\times400\leqq0.020\%$, and a ratio of transverse direction toughness to longitudinal direction toughness, wherein said longitudinal direction means a direction of elongation by forging and said transverse direction means a direction perpendicular to said longitudinal direction, being more than 0.70.

4. The isotropic tool steel according to claim 3, wherein S is less than 0.003 weight %, and the cleanliness of said tool steel with respect to non-metallic inclusions determined by JIS G 0555 is $dA60\times400\leqq0.005\%$.

5. The isotropic tool steel according to claim 3, wherein S is less than 0.003 weight %, the cleanliness with . respect to non-metallic inclusions determined by JIS G 0555 is $dA60\times400\leqq0.005\%$, and the ratio of T-direction toughness to L-direction toughness is 0.85 or more.

6. Isotropic tool steel consisting essentially, by weight, of 0.30–0.45% of C, 2.00% or less of Si, 2.0% less of Mn, 7.00% or less of Cr, 0.20–12.0% of W and/or Mo alone or in combination ($\frac{1}{2}W+Mo$), 3.00% or less of V, less than 0.005% or S and less than 30 ppm of O, the balance being substantially Fe, the cleanliness of said tool steel with respect to non-metallic inclusions determined by JIS G 0555 being $dA60\times400\leqq0.010\%$ and $d(B+C)60\times400\leqq0.020\%$, and a ratio of transverse directoin toughness to longitudinal direction toughness, wherein said longitudinal direction means a direction of elongation by forging and said transverse direction means a direction perpendicular to said longitudinal direction, being more than 0.70.

7. The isotropic tool steel according to claim 6, wherein the amount of O is less than 20 ppm.

8. The isotropic tool steel according to claim 6, wherein said tool steel further consists essentially of at least one of 4.00% or less of Ni, 6.50% or less of Co and 0.20% or less of N; 0.50% or less of carbide-forming element selected from the group consisting of Nb, Ti and a mixture thereof, and 3.00% or less of a precipitation hardening element, capable of forming intermetallic compounds, selected from the group consisting of Cu, B, Al, Be and a mixture thereof.

9. Isotropic tool steel consisting essentially, by weight, of 0.30–0.45% of C, 200% or less of Si, 0.80% or less of Mn, 4.50–5.50% or less of Cr, 1.00–1.60% of Mo, 0.50–1.30% of V, less than 0.005% of S and less than 30 ppm of O, hte balance being substantially Fe, the cleanliness of said tool steel with respect to non-metallic inclusions determined by JIS G 0555 being $dA60\times400\leqq0.010\%$ and $d(B+C)60\times400\leqq0.020\%$, and a ratio of transverse direction toughness to longitudinal direction toughness, wherein said longitudinal direction means a direction of elongation by forging and said transverse direction means a direction perpendicular to said longitudinal direction, being more than 0.70.

* * * * *